United States Patent [19]

Takase

[11] 4,312,315

[45] Jan. 26, 1982

[54] SYSTEM FOR DIGITAL CONTROL OF OPERATION OF INTERNAL COMBUSTION ENGINE

[75] Inventor: Sadao Takase, Yokohama, Japan

[73] Assignee: Nissan Motor Company, Limited, Yokohama, Japan

[21] Appl. No.: 140,664

[22] Filed: Apr. 15, 1980

[30] Foreign Application Priority Data

Apr. 16, 1979 [JP] Japan ..... 54-45325

[51] Int. Cl.[3] ..... F02B 77/00

[52] U.S. Cl. ..... 123/479; 123/198 DB; 123/335; 123/339; 123/48 D

[58] Field of Search ..... 123/198 DB, 479, 335, 123/480, 339, 352

[56] References Cited

U.S. PATENT DOCUMENTS

| | | | |
|---|---|---|---|
| 3,572,302 | 3/1971 | Wollesen | 123/335 |
| 3,757,571 | 9/1973 | Chamberas | 123/335 |
| 4,006,718 | 2/1977 | Konomi | 123/479 |
| 4,058,106 | 11/1977 | Drews | 123/198 DB |
| 4,198,933 | 4/1980 | Sieber | 123/198 DB |
| 4,213,181 | 7/1980 | Carp | 123/480 |
| 4,237,838 | 12/1980 | Kinugawa | 123/339 |

FOREIGN PATENT DOCUMENTS

| | | | |
|---|---|---|---|
| 2308791 | 4/1976 | France | 123/479 |
| 55-32919 | 7/1980 | Japan | 123/479 |
| 1439422 | 4/1974 | United Kingdom | 123/480 |

*Primary Examiner*—Ronald B. Cox

*Attorney, Agent, or Firm*—Schwartz, Jeffery, Schwaab, Mack, Blumenthal & Koch

[57] ABSTRACT

A system to control operation of an IC engine, comprising, as a principal subsystem, a digital control system for executing computing processing by using inputs representative of parameters of engine operating conditions, including an engine speed signal, thereby producing a control signal to control at least one actuator which can regulate a factor of engine operation. The digital control system comprises means for examining the length of pulse intervals of the engine speed signal and discriminating means for forming a judgement that the engine is stalling when the pulse intervals continue to be longer than a predetermined length of time for a predetermined period of time, so that the system does not misjudge the presence of a noise signal to be an indication of engine stall.

5 Claims, 6 Drawing Figures

FROM 14
32
REGISTER
34
COMPARATOR
36
COUNTER
Pc
St
38
REGISTER
40
COMPARATOR
42
COUNTER
Pc
FROM 14
44
FLIP-FLOP
46
NAND
Sd
48
ACTUATOR DRIVER

SYSTEM FOR DIGITAL CONTROL OF OPERATION OF INTERNAL COMBUSTION ENGINE

BACKGROUND OF THE INVENTION

This invention relates to a system to control the operation of an internal combustion engine, which system is of a type comprising transducers to detect parameters of the engine operating conditions, digital control means for repeatedly executing computing processes by utilizing the detected parameters as input information and at least one actuator whose operation is controlled by the output of the digital control means.

A digital control system of the above stated type is principally constituted of a data treatment device to read in input data necessary for computation processing, a write-and-read type memory device, an arithmetic or arithmetic-logic unit and an output-data conversion device. When a subsystem is operated in places or under conditions where external noises of considerable intensities break out frequently as typified in applications to automobiles, the input and output devices, memory device and the arithmetic-logic unit are liable to be influenced by such external noises and, therefore, there is a danger of the control system producing an erroneous output.

For example, the control system has capabilities to instantly judge that the engine is stalling when the rotational speed of the engine falls below a predetermined value and quickly change its output so as to restore an actuator or actuators each to a preset state. But if an error is made in the estimation of the engine speed it becomes difficult to accurately discriminate between normal operation of the engine and stall of the engine. Sometimes, an erroneous function of a certain part of the control system caused by an external noise results in the control system providing an erroneous output which brings about stalling of the engine. Moreover, there is a possibility that an erroneous function of the control system under the stimulus of noise will cause an actuator to continue an erroneous function which invites danger. For example, danger of fire is incurred when a fuel injection valve is uncontrollably left of in an open state, or an ignition circuit brings on a danger of generating extraordinary heat and/or being damaged by burning when a current is allowed to continue flowing through an ignition coil.

In a broad sense an object of the present invention is to prevent a digital control system for the control of the operation of an internal combustion engine from producing an erroneous output in response to an erroneous input or a noise signal.

It is a primary object of the present invention to provide an improved system for the control of the operation of an internal combustion engine, which system is of the hereinbefore described type and, as the improvement, has the capabilities of accurately recognizing a real stall of the engine without being affected by external noises and then holding its output to at least one actuator in a state prescribed for the case of engine stalling.

The present invention provides a control system which includes sensor means for detecting parameters of operating conditions of an internal combustion engine and a digital control means for repeatedly executing computing processing by utilizing the parameters detected by the sensor means as input information thereby producing a control signal to control the operation of at least one actuator which regulates a factor of operation of the engine. The sensor means include means for producing a pulse signal representative of the rotational speed of the engine. According to the present invention, the digital control means in this control system comprise a comparing means for comparing pulse intervals between two successive pulses of the pulse signal representative of the engine speed with a predetermined length of time and discriminating means for judging that the engine is stalling when the pulse intervals subjected to comparison continue to be longer than the predetermined length of time for another predetermined length of time.

Because of the above stated construction, the control system of the invention does not instantly judge that the engine is stalling when the engine speed signal momentarily implies a considerably low rotational speed but, instead, examines whether the engine speed signal continues to imply such a low engine speed condition for a predetermined period of time. Only when an affirmative result is obtained this control system forms a judgement that the engine is stalling. Since generally noise signals do not exist continuously, this control system can accurately discriminate noise signals from a correct signal which implies a real stall of the engine.

The comparing means may be made to have the function of generating a pulse each time a pulse interval of the engine speed signal becomes longer than a predetermined length of time such that, if the pulse generation is repeated, the pulses are generated at a constant interval. In this case the discriminating means are made to have the capabilities of counting the number of pulses produced by the comparing means and judging that the engine is stalling when the result of the counting reaches a predetermined number.

DESCRIPTION OF THE PREFERRED EMBODIMENTS

Figure 1:
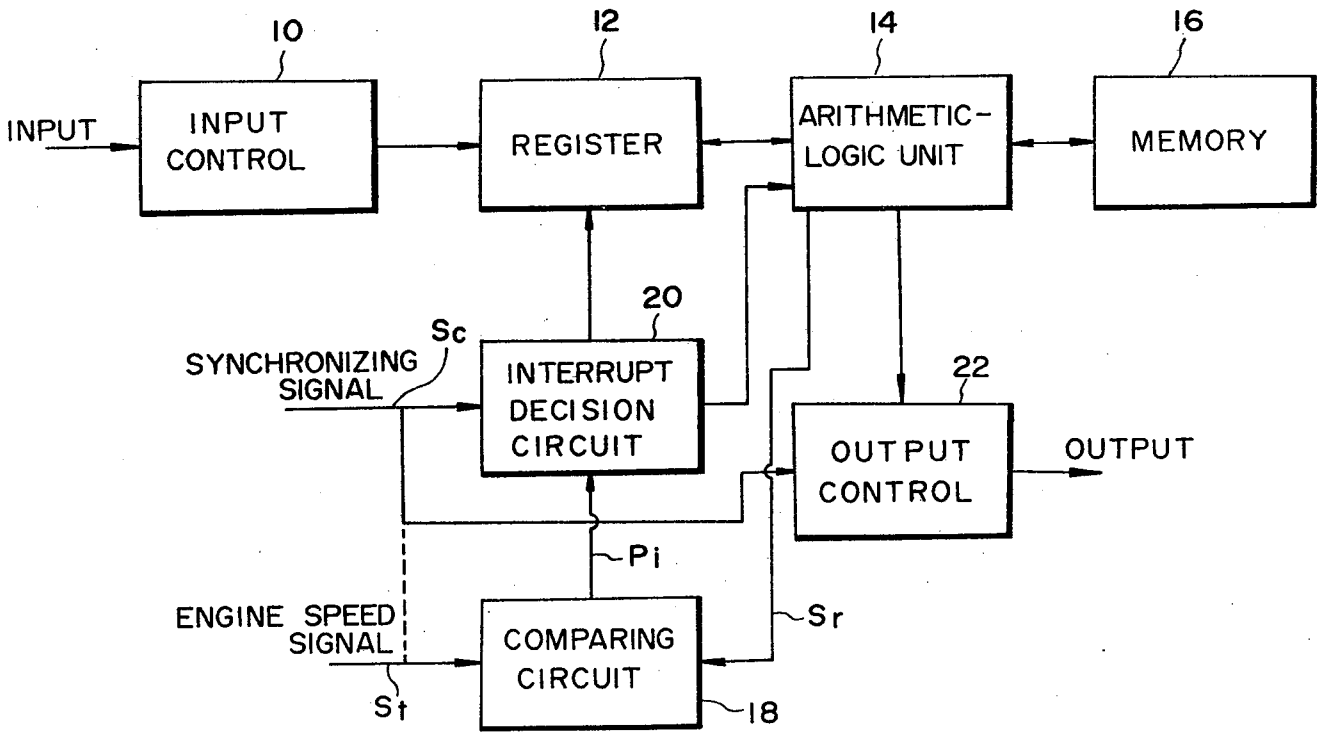
FIG. 1 is a block diagram of a control system according to the present invention.

FIG. 1 shows a digital control system, as an embodiment of the present invention, to control the operation of an internal combustion engine (not shown). This control system has an input control circuit 10 which usually includes a multiplexor and an analog-digital converter to accomplish conversion of input signals, each representative of a parameter of operating conditions of the engine, into digital signals suited to processing in this control system. A register 12 stores the digital signals supplied from the input control circuit 10. An arithmetic-logic unit 14 is linked with the register 12. An a memory device 16 memorizes constant data necessary for computation operations in the arithmetic-logic unit 14, intermediate results of computation in the unit 14 and programs to instruct the flow of the digital control. According to the invention, the control system includes a comparing circuit 18 and an interrupt decision circuit 20. The comparing circuit 18 receives an engine speed signal $S_t$ which is a pulse signal representative of the rotational speed of the crankshaft of the engine and a reference signal $S_r$, which is provided by the arithmetic-logic unit 14 and represents a predetermined length of time. Circuit 18 performs a comparison between each pulse interval of the engine speed signal $S_t$ and the length of time the reference signal $S_r$ represents. When the pulse interval of the signal $S_t$ becomes equal to or longer than the predetermined interval implied by the signal $S_r$, the comparison circuit 18 outputs an interrupt demand signal $P_i$ which is fed into the interrupt decision circuit 20.

The interrupt decision circuit 20 receives a synchronizing signal $S_c$ and has the function of analyzing the interrupt demand signal $P_i$ thereby instructing the register 12 and the arithmetic-logic unit 14 to execute a specific routine to examine whether the engine is stalling or not. The function of this circuit 20 will further be described hereinafter.

In this control system, an output control unit 22 comprises registers to store output data and a converter to accomplish necessary conversion of the output data and produces an output signal to control at least one actuator which has the function of regulating a factor of the engine operation, e.g. feed of fuel, based on the external synchronizing signal $S_c$ which is supplied also to this unit 22 and a control signal provided by the arithmetic-logic unit 14.

The synchronizing signal $S_c$ may be produced either by a transducer which detects the rotational speed of the engine or by a timer. In the former case, the engine speed signal $S_t$ produced for the comparing circuit 18 may be utilized also as the synchronizing signal $S_c$ for the interrupt decision circuit 20 and the output control unit 22.

Figure 2:
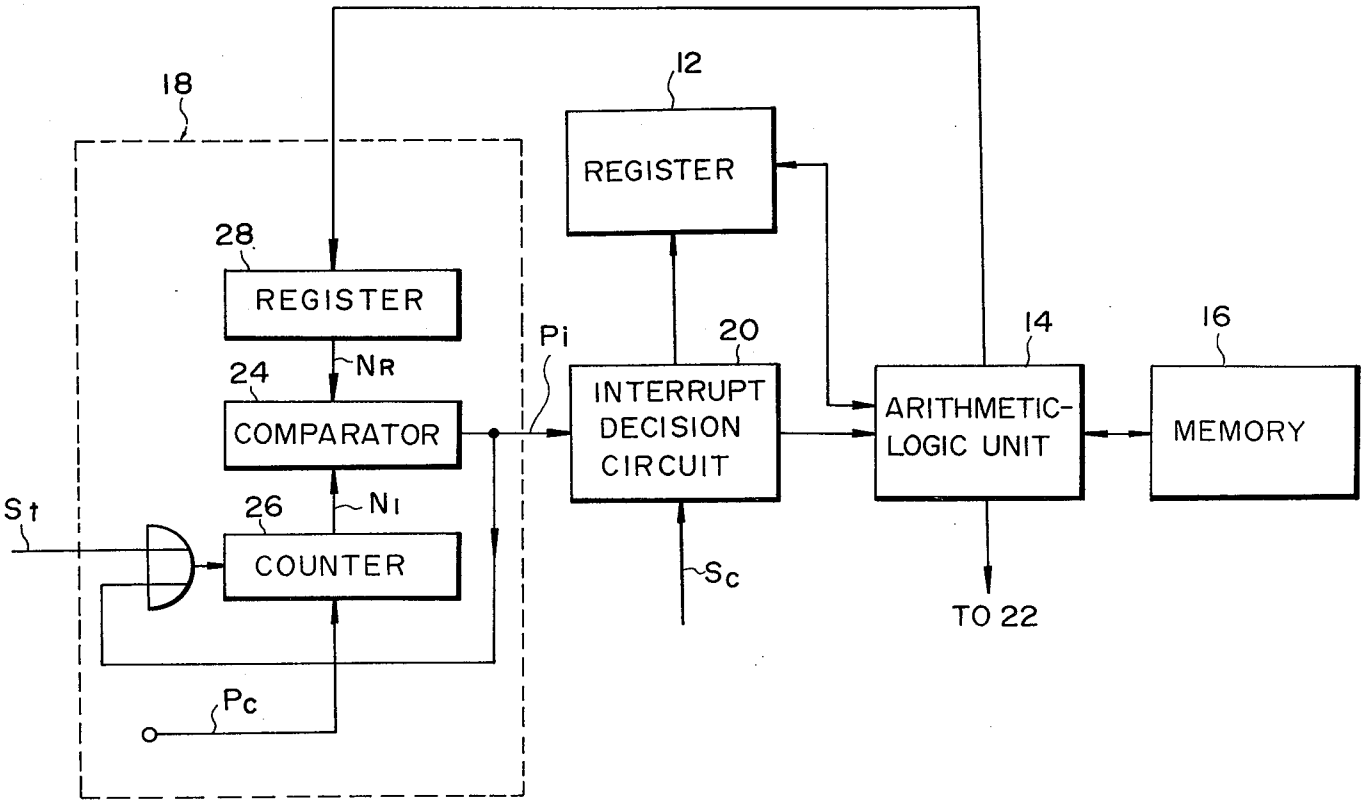
FIG. 2 shows, in a block diagram, an example of the comparing circuit in the system of FIG. 1.

FIG. 2 shows particularly the construction of the comparing circuit 18 adapted to detect a stall of the engine. This circuit 18 comprises a comparator 24, a counter 26 and a register 28. The counter 26 receives a clock signal $P_c$ and is triggered by an individual pulse of the engine speed signal $S_t$, which serves as a timing signal, to start counting the number of pulses of the clock signal $P_c$. By the next pulse of the timing signal $S_t$, the counter 26 is reset to restart the same counting operation. The counter 26 outputs the results of the count as an output signal $N_1$. The comparator 24 receives this signal $N_1$ and a reference signal $N_R$ which is supplied from the arithmetic-logic unit 14 through the register 28. The comparator 24 continues to make a comparison between these two signals $N_1$ and $N_R$ and generates a lone pulse $P_i$ each time when the value implied by the output of the counter 26 coincides with the meaning of the reference signal $N_R$. Each pulse $P_i$ produced by the comparator 24 is fed into the interrupt decision circuit 20 and at the same time utilized to reset the counter 26.

Thus, the comparing circuit 18 outputs a pulse signal $P_i$ when the timing signal $S_t$ exhibits a pulse interval longer than a predetermined length of time and also when the supply of the timing signal $S_t$ is interrupted. This pulse signal $P_i$ is of a constant pulse interval which is determined by the data stored in the register 28. At the initial setting of the control system, a required value, such as a critical rotational speed of the engine (determined for each model of the engine) below which the comparator 24 should produce the pulse signal $P_i$, is written into the register 28.

Figure 3:
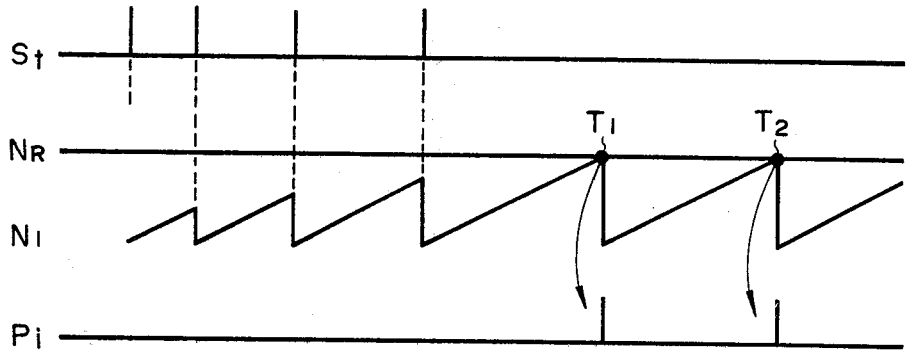
FIG. 3 is a timing diagram showing various signals output from the respective elements of the comparing circuit of FIG. 2.

FIG. 3 illustrates relationships among the signals $S_t$, $N_R$, $N_1$ and $P_i$. Actually these signals are all digital signals, but they are illustrated as analog signals for the sake of convenience. Since the output $N_i$ of the counter 26 implies the number of pulses of the clock signal $P_c$ counted in a time period between two successive pulses of the timing signal $S_t$, the output $N_1$ represents larger values as the engine undergoes a lowering of its rotational speed or comes to a halt. When the value represented by the counter output $N_1$ reaches the value stored in the register 28 and implied by the reference signal $N_R$, as indicated at $T_1$ in the chart, the comparator 24 generates a single pulse. If such a condition of the timing signal $S_t$ continues, the comparator 24 generates another pulse at a time point $T_2$ a definite amount of time after $T_1$. Each of a series of such pulses generated by the comparator 24 serves as the interrupt demand signal $P_i$.

Figure 4:
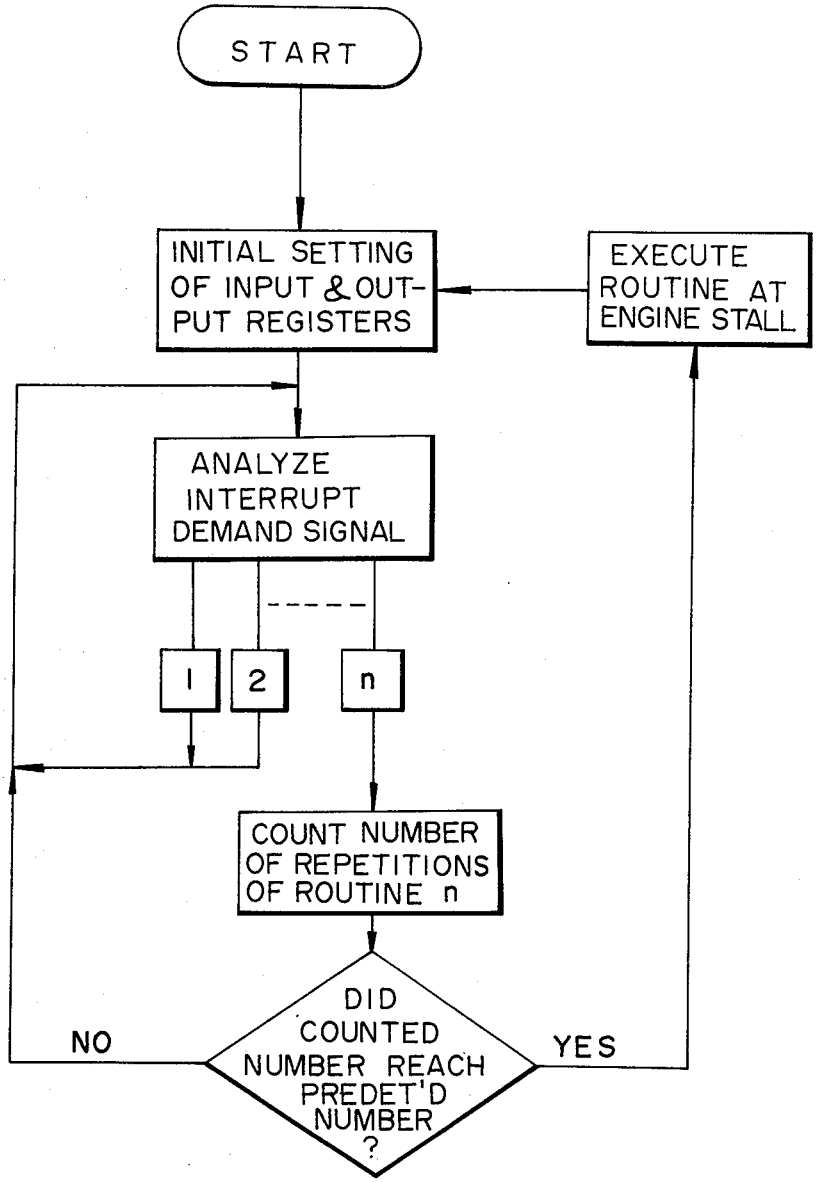
FIG. 4 is a flow chart showing the outline of the operation of the arithmetic-logic unit in the control system of FIGS. 1 and 2.

A digital control process by the control system of FIG. 1 is performed according to the flow shown in FIG. 4. Upon the start of operation, initial data are set in the respective registers for input and output signals, and both the comparing circuit 18 and the interrupt decision circuit 20 start functioning. When the comparing circuit 18 generates each pulse $P_i$ as an interrupt demand signal, the interrupt decision circuit 20 analyzes this signal $P_i$ and commands the register 12 and the arithmetic-logic circuit 14 to start executing a specific routine to detect a stall of the engine, for example n-th routine among prescribed routines 1,2, . . . ,n. A definite memory area of the memory device 16 constitutes a counter to count the number of repetitions of the execution of this routine n. In the arithmetic-logic unit 14, the number given by the counting operation is compared with a preset number after each run of the routine n, and only when the comparison results in an agreement of the compared two numbers, that is, when the execution of the routine n is repeated a preset number of times, it is judged that the engine is really stalling. Then the arithmetic-logic unit 14 commences to execute a specific routine prescribed for the case of engine stalling. More particularly, this routine causes the output control circuit 22 to hold particular data needful in the case of engine stalling in the registers of this circuit 22 and at the same time sets the output of this control system in an invariably predetermined state. The aforementioned counter in the memory device 16 is reset by the pulse signal representative of the engine speed.

In the control system of FIGS. 1 and 2, the comparing circuit 18 generates a pulse as the interrupt demand signal $P_i$ every time the engine speed signal $S_t$ disappears or implies a predetermined low value. However, the arithmetic-logic unit 14 does not instantly judge the arrival of the pulse signal $P_i$ to be the occurrence of a stall of the engine but forms a judgement that the engine is stalling only when pulses of the interrupt demand signal $P_i$ are generated successively for a predetermined length of time. Since generally an erroneous signal attributed to an external noise does not exist continuously, the employment of this digital control system makes it possible to avoid forming an unduly quick and incorrect judgement that the engine is stalling while the control system is operated in the presence of external noises. If the arithmetic-logic unit 14 is not provided with the above described discriminating function, meaning that the output $P_i$ of the comparing circuit 18 is directly utilized as an engine stall signal, there is a strong possibility of misjudging the appearance of a noise signal to be occurrence of a stall of the engine.

Referring to FIGS. 2–4, assume that the generation of the signal $P_i$ for a time period of 3 sec can be detected in the arithmetic-logic unit 14 when a value 30 is stored in the register 28 and that the predetermined number of repetition of execution of the routine n is set at 1 (one). It is also possible to detect the time period of 3 sec by reducing the value written in the register 28 to 10 and changing the predetermined number of repetitions of the routine n to 3. However, the latter method is more advantageous when the influence of a noise signal resembling each pulse of the interrupt demand signal $P_i$ is taken into consideration.

Figure 5:
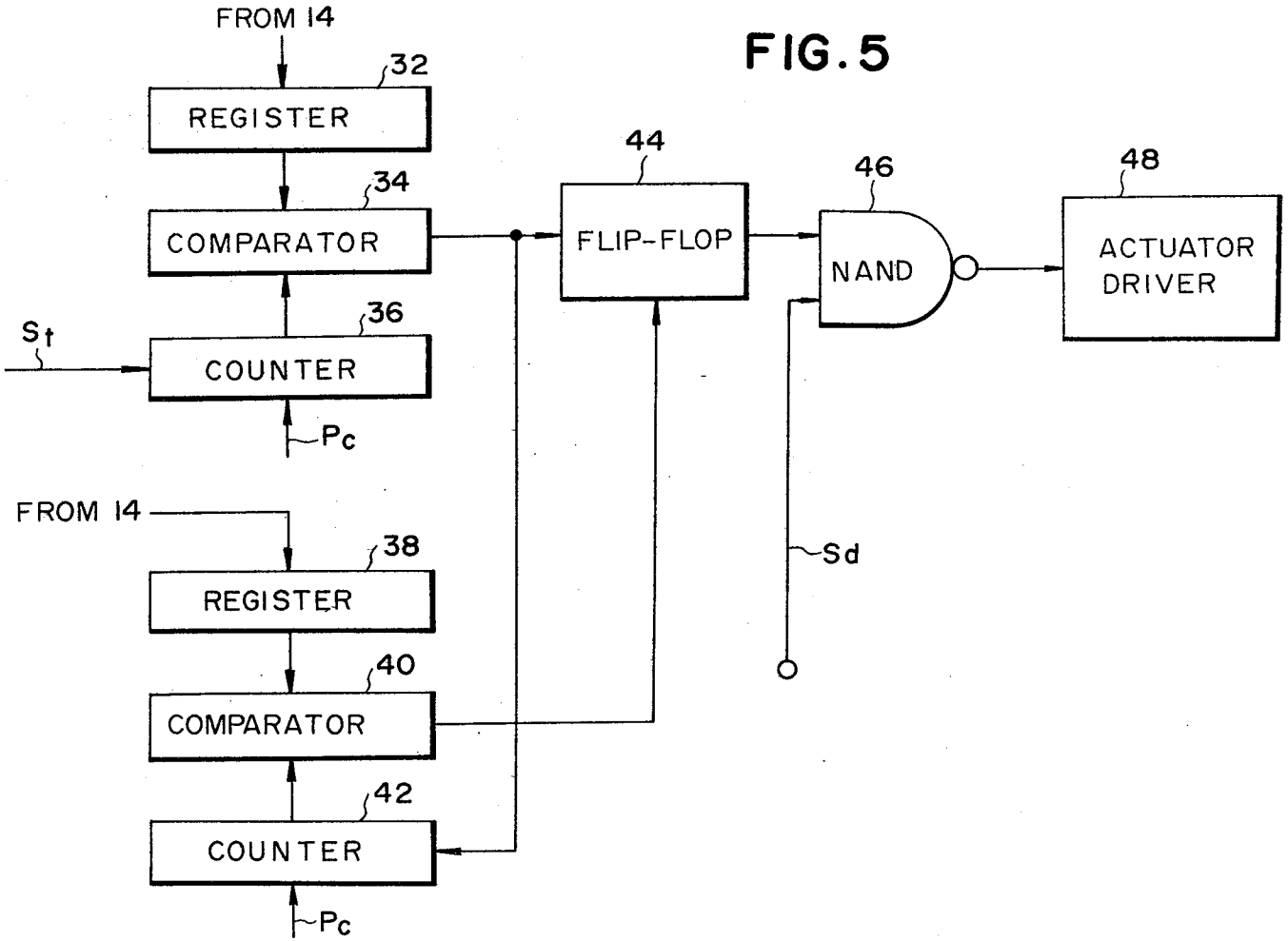
FIG. 5 is a block diagram of an engine ignition control circuit which is associated with the control system of FIGS. 1 and 2.

FIG. 5 shows a circuit for producing an ignition disabling signal to explain an example of the routine executed by the arithmetic-logic unit 14 after recognition of a stall of the engine. A register 32 stores the result of a computing process, for example either an angular distance or a time period from a position where the timing signal is produced to the position of ignition. A counter 36 is triggered by the timing signal $S_t$ to count the pulses of the clock signal $P_c$ or alternatively of an angle signal. A comparator 34 generates an output pulse when an exact agreement is reached between the value stored in the register 32 and the reading of the counter 36, which output resets the counter 36 and at the same time causes a flip-flop 44 to assume a first state. A register 38 stores either an angular distance or a time period from the position of ignition to a position at which the next application of ignition current occurs. A counter 42 and a comparator 40 correspond functionally to the aforementioned counter 36 and comparator 34. That is, the counter 42 is triggered by an output pulse the comparator 34 generates to count the pulses of the clock signal $P_c$, and the output of the comparator 40 resets the counter 42 and at the same time causes the flip-flop 44 to assume a second state. The output of the flip-flop 44 is supplied to a driving unit 48 of an actuator through a NAND gate 46.

Figure 6:
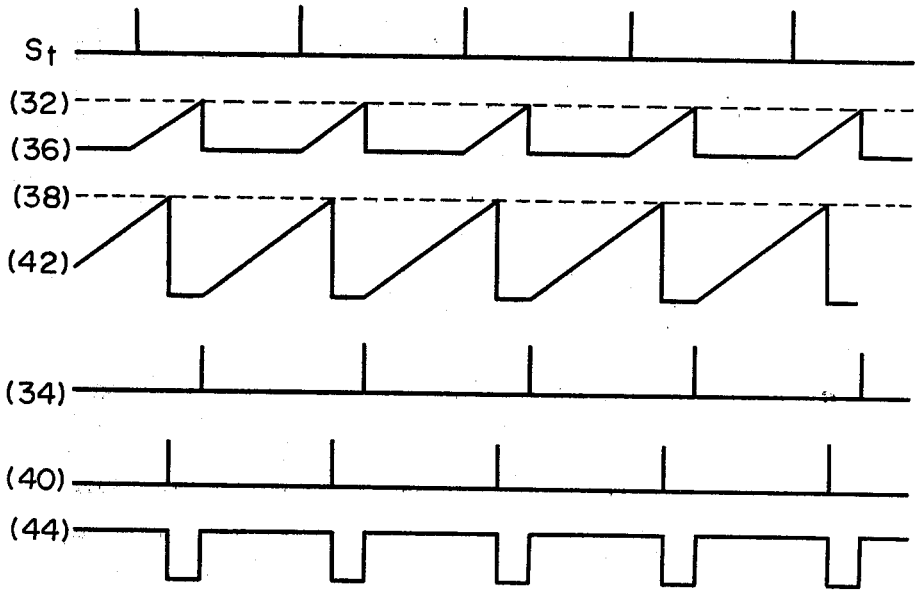
FIG. 6 is a timing diagram showing various signals put out of the respective elements of the circuit of FIG. 5.

FIG. 6 illustrates the outputs of the respective elements of the circuit of FIG. 5. Actually these outputs are all digital signals, but they are illustrated as analog signals for the sake of convenience. In FIG. 6, numerals in parentheses respectively correspond to reference numerals in FIG. 5. The counter 36 starts counting in response to each pulse of the timing signal $S_t$ and is reset when the counted number comes into agreement with the value stored in the register 32. At this point in time the comparator 34 provides an output which causes the flip-flop 44 to assume the first state, and at the same time the counter 42 starts counting. When the resultant count in the counter 42 reaches the value stored in the register 38, counter 42 is reset, and at the same time the comparator 40 provides an output which causes the flip-flop 44 to assume the second state.

The arithmetic-logic unit 14 forms a judgement that the engine is stalling through the computation process described hereinbefore and then provides an ignition disabling signal $S_d$, such as a zero volt signal, to the other input terminal of the NAND gate 46. As a result, the actuator drive unit 48 interrupts the application of current to the ignition coil.

Also, fuel feed to the engine can be interrupted by closing a fuel injection valve and/or stopping the operation of a fuel pump by the employment of a control circuit similar to that shown in FIG. 5. That is, either a drive unit for the fuel injection valve or a fuel pump driving unit is disabled by holding a flip-flop in the output section of the control circuit in the first state and/or by utilizing a NAND gate.

As will have been understood from the foregoing description, the present invention concerns a digital control system which proposes to correctly detect an engine stall condition by monitoring not only the rotational speed of the engine but also the duration of a particularly low engine speed condition and, in the case of the engine really stalling, to hold the output of the control system connected to the object(s) of control in an invariably prescribed state. Thus an unintended control output resulting from erroneous function of a certain part of the digital control system can be kept from dangerously or detrimentally influencing any actuator or its driving element.

What is claimed is:

1. In a system to control the operation of an internal combustion engine, the system having sensor means for producing electrical signals respectively representing parameters of operating conditions of the engine and a digital control means for repeatedly executing computing processing by utilizing said electrical signals as input information thereby producing a control signal to control the operation of at least one actuator which can regulate a factor of operation of the engine, the sensor means including means for producing a pulse signal representative of the rotational speed of the engine, the improvement comprising: said digital control means including comparing means for comparing pulse intervals between two successive pulses of said pulse signal with a predetermined length of time, and discriminating means for forming a judgement that the engine is stalling when said pulse intervals continue to be equal to or longer than said predetermined length of time for another predetermined length of time; said comparing means comprising:

first means for storing a reference signal which implies said predetermined length of time; second means for detecting the time length of each of said pulse intervals; and third means for generating a pulse each time the time length of any one of said pulse intervals corresponds to said predetermined length of time implied by said reference signal; said discriminating means comprising means for examining whether the generation of said pulse by said third means of said comparing means is repeated a predetermined number of times during said another predetermined length of time.

2. A system according to claim 1, wherein said digital control means include output control means for holding said output in an invariably predetermined state when said judgement is formed.

3. A system according to claim 1, wherein said second means and said third means of said comparing means are constructed such that when said pulse intervals continue to be equal to or longer than said predetermined length of time the generation of said pulse by said third means is repeated so as to provide a series of pulses at a constant pulse interval.

4. A system according to claim 3, wherein said second means of said comparing means comprise a counter to count the number of pulses of a clock signal appearing in each of said pulse intervals.

5. A system according to claim 3, wherein said discriminating means comprise an arithmetic-logic unit and interrupt control means for providing an interrupt command signal to said arithmetic-logic unit each time said comparing means generate said pulse, said arithmetic-logic unit having the functions of repeatedly executing a prescribed routine upon receipt of said interrupt command signal, comparing the number of repetitions of exeuction of said routine with a predetermined number after each run of said routine and forming a judgement that the engine is stalling when said number of repetitions reaches said predetermined number.

* * * * *